US008657409B1

(12) United States Patent
Gemmell et al.

(10) Patent No.: US 8,657,409 B1
(45) Date of Patent: Feb. 25, 2014

(54) LINE PRINTER HAMMER BANKS

(71) Applicant: Printronix, Inc., Irvine, CA (US)

(72) Inventors: John W. Gemmell, Aliso Viejo, CA (US); Rohit Sharma, Yorba Linda, CA (US); Rudy Concepcion, Rancho Santa Margarita, CA (US)

(73) Assignee: Printronix, Inc., Irvine, CA (US)

( * ) Notice: Subject to any disclaimer, the term of this patent is extended or adjusted under 35 U.S.C. 154(b) by 0 days.

(21) Appl. No.: 13/654,095

(22) Filed: Oct. 17, 2012

(51) Int. Cl.
*B41J 2/155* (2006.01)

(52) U.S. Cl.
USPC ..... 347/42; 347/53

(58) Field of Classification Search
USPC ..... 347/40, 42, 44, 49, 53, 111, 112
See application file for complete search history.

(56) References Cited

U.S. PATENT DOCUMENTS 4,941,405 A * 7/1990 Helms ..... 101/93.04
6,109,802 A * 8/2000 Iwama et al. ..... 400/279

* cited by examiner

*Primary Examiner* — Thinh Nguyen
(74) *Attorney, Agent, or Firm* — Haynes and Boone, LLP

(57) ABSTRACT

In one embodiment, a hammer bank for a line printer includes a back plate and a plurality of elongated pole pieces extending forwardly from a front surface thereof. Each of the pole pieces has an electrical coil disposed about a circumfery thereof. A permanent magnet has a back surface coupled to the front surface of the back plate, and a shunt fret defining a plurality of elongated, downwardly extending shunts has a back surface coupled to a font surface of the permanent magnet. A hammer fret defining a plurality of elongated, upwardly extending hammers has a back surface coupled to the front surface of the back plate. Each of the hammers is interdigitated between a pair of adjacent shunts. Each hammer includes an elongated spring portion having a hammer head disposed at an upper end thereof, and each hammer head has a forwardly projecting printing tip thereon.

20 Claims, 8 Drawing Sheets

Fig. 2 - Prior Art

*Fig. 3 - Prior Art*

LINE PRINTER HAMMER BANKS

BACKGROUND

1. Technical Field

This invention relates to line printers in general, and more particularly, to hammer banks for line printers that are both easier and lower in cost to manufacture and service.

2. Related Art

Line impact matrix printers, or line printers, produce letters and graphics in the form of a matrix of dots by employing a "shuttle" mechanism that runs back and forth in a horizontal direction over a page of a print medium, such as single sheet or continuous form paper, coupled with movement of the page perpendicular to that of the shuttle. An inked "ribbon" is typically interposed between the shuttle and the page. The shuttle comprises a "hammer bank," i.e., an inline row of cantilevered, magnetically retracted hammer printing tips respectively disposed on the ends of elongated spring fingers, or "hammers," each of which is selectively "triggered," i.e., electromagnetically released, and timed so as to impact the page through the ink ribbon and thereby place a dot of ink on the page. As a result of the ability to precisely overlap the ink dots produced thereby, line printers can produce vertical, horizontal and diagonal lines that have a solid appearance, and print that closely resembles that of "solid font" printers, and refined graphics similar to those produced by graphics plotters, at speeds of up to 2000 lines per minute. Additionally, because the printing involves impact or mechanical pressure, these printers can also produce carbon and carbonless copies.

Examples of hammer banks for line printers can be found in the patent literature, including U.S. Pat. Nos. 6,779,935 and 6,821,035, both to John W. Gemmell, the respective disclosures of which are incorporated herein by reference. While these and other prior art line printer hammer banks can provide satisfactory print quality and speeds, they are not without some drawbacks.

For example, prior art hammer banks typically comprise a machined or die cast base part that is relatively expensive to make, and which is substantially integrated in the shuttle mechanism, which makes both the shuttle mechanism and the hammer bank more difficult and expensive to manufacture and to remove for servicing or replacement of the hammer bank in the field. Additionally, conventional hammer banks typically incorporate relatively complex, dual-pole-piece magnetics for the control of each hammer, which adds to their complexity and cost of manufacture.

Accordingly, there is a long felt but as yet unsatisfied need in the relevant industry for hammer bank designs that are both efficient and reliable, yet which are easier and lower in cost to manufacture and service.

SUMMARY

In accordance with embodiments of the present invention, hammer banks for line impact printers are provided that are both efficient and reliable, yet substantially easier and lower in cost to manufacture and service than prior art devices.

In one embodiment, a novel hammer bank for a line printer includes a back plate and a plurality of elongated pole pieces extending forwardly from a front surface thereof. Each of the pole pieces has an electrical coil disposed about a circumfery thereof. A permanent magnet has a back surface coupled to the front surface of the back plate, and a shunt fret defining a plurality of elongated, downwardly extending shunts has a back surface coupled to a font surface of the permanent magnet. A hammer fret defining a plurality of elongated, upwardly extending hammers has a back surface coupled to the front surface of the back plate. Each of the hammers is interdigitated between a pair of adjacent shunts. Each hammer includes an elongated spring portion having a hammer head disposed at an upper end thereof, and each hammer head has a forwardly projecting printing tip thereon.

A better understanding of the above and many other features and advantages of the novel line printer hammer banks of the present disclosure and their manufacture and use can be obtained from a consideration of the detailed description of some example embodiments thereof below, particularly if such consideration is made in conjunction with the appended drawings, wherein like reference numerals are used to identify like elements illustrated in one or more of the figures thereof.

DETAILED DESCRIPTION

In accordance with the present disclosure, embodiments of hammer banks for line printers are provided, together with methods for making them, that are both efficient and reliable, yet substantially easier and lower in cost to manufacture and service than prior art devices.

Figure 1:
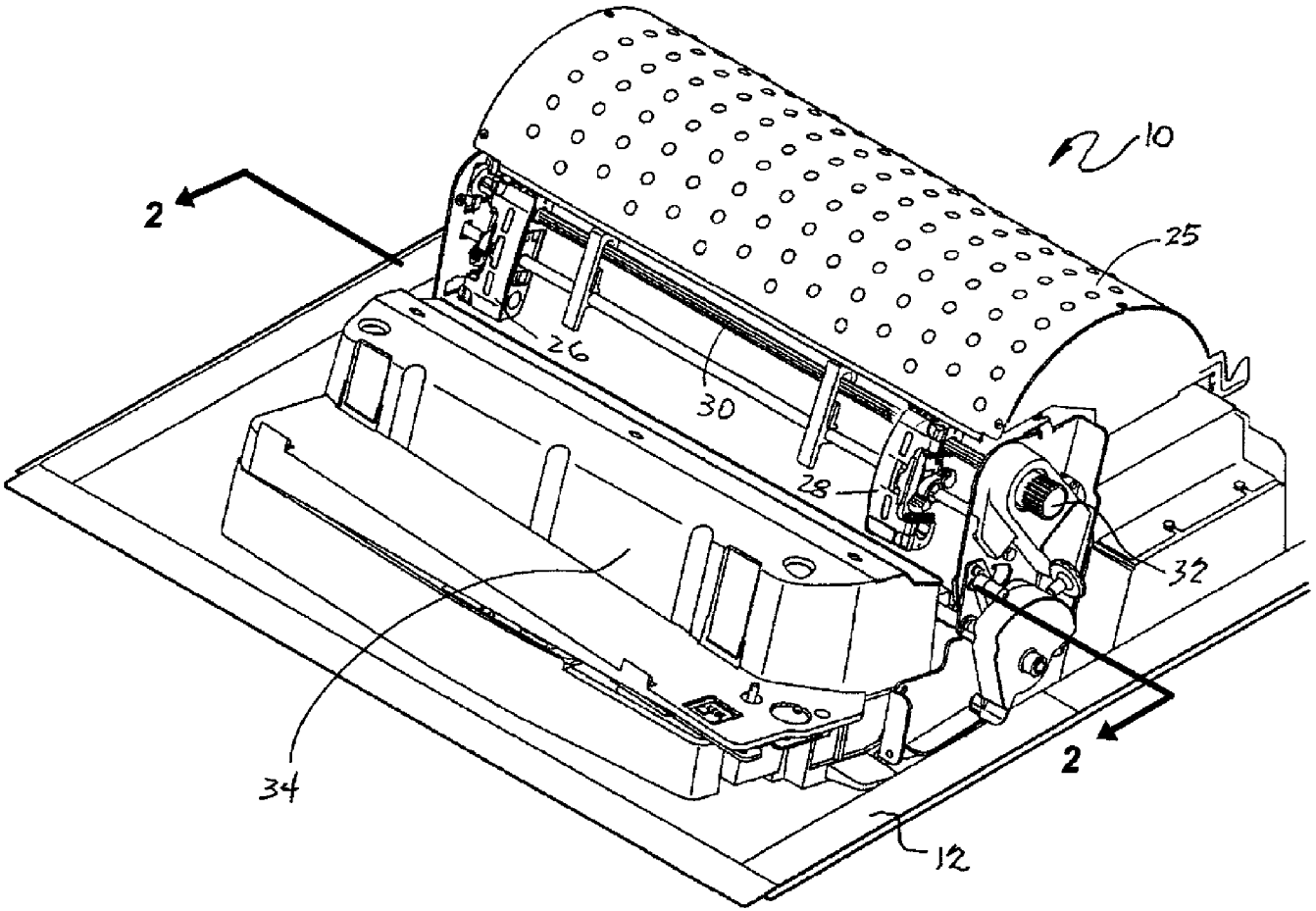
FIG. 1 is a partial, upper, front and right-side perspective view of an example line matrix impact printer within which embodiments of the hammer banks of the present invention can be advantageously employed.

FIG. 1 is a perspective view of an example line matrix impact printer 10 within which embodiments of the present invention can be advantageously employed. As illustrated in FIG. 1, the printer 10 can be mounted on a stand or a base, or incorporated in a cabinet. In the particular embodiment illustrated, the printer 10 is shown supported within a base frame 12. The base frame 12 supports all of the various components of the printer 10, including a cartridge ribbon system (not illustrated), which comprises an "endless" or Mobius strip of ink ribbon housed inside a cartridge that is fed across the print medium by a motor that creates tension on the ribbon by use of gears on one side and a tension spring on the opposite side of the cartridge. The cartridge ribbon system feeds ribbon horizontally over a print medium, such as paper, to enable ink transfer from the ribbon to the paper and thereby create printed images as the hammers fire.

In the example embodiment illustrated in FIG. 1, the print medium is arranged to advance vertically over an arcuate support plate 25. The print medium can comprise, for example, single sheets, fan-fold forms or continuous sheets, bar code labels, combinations of plastic and paper labels and formats, paper media for text and graphics, and other such materials. In the particular embodiment illustrated in FIG. 1, the print medium is moved vertically up and over the support plate 25 by sprocket drive "tractors" 26 and 28, which are conjointly driven by a media drive shaft 30. Of course, other known media drive mechanisms, such as frictional drive wheels, can also be used. The media drive shaft 30 also incorporates a knurled knob 32 for manually incrementing the vertical position of the print medium. The knob 32 can be utilized to move the print medium manually, e.g., for indexing or initial alignment of the print medium, or for other purposes.

The example line printer 10 of FIG. 1 further includes a "shuttle" 34 incorporating a scotch yoke mechanism that causes a "hammer bank" 36 (see FIG. 2) to be driven back and forth over the ink ribbon and the print medium in the horizontal direction. As described in more detail below, the hammer bank 36 includes an inline row of cantilevered, magnetically retracted "hammers," i.e., printing tips respectively disposed on the ends of elongated spring fingers, each of which is selectively "triggered," i.e., electromagnetically released, and timed so as to impact the page through the ink ribbon and thereby place a dot of ink on the page.

Figure 2:
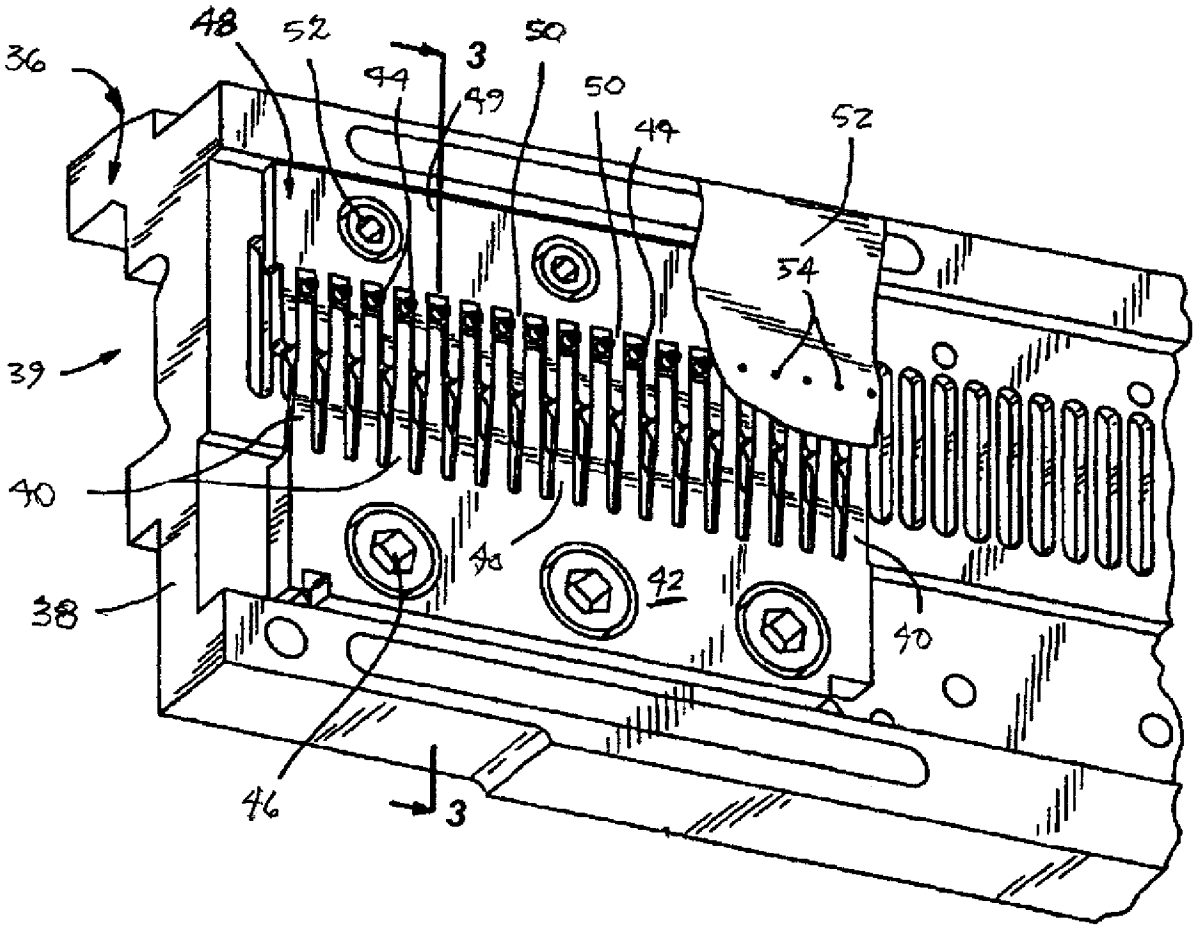
FIG. 2 is a partial, lower, front and left-side perspective view of a front face of an embodiment of a hammer bank in accordance with the prior art, as seen along the lines of the section 2-2 taken in FIG. 1.

FIG. 2 is a partial perspective view of a front face of a prior art hammer bank 36, as seen along the lines of the section 2-2 taken in FIG. 1. As illustrated in FIG. 2, the prior art hammer bank 36 includes a machined or die cast base part 38 and a plurality of inline hammers 40 that are formed integrally in a comb-like "hammer fret" 42 that is mounted on the front face of the base 38. Each of the hammers 40 has a "head" or upper end terminating in an elongated printing tip 44. The hammer fret 42 and the integral hammers 40 can be secured by screws 46 or other types of fastening mechanisms onto the base 38 of the hammer bank 36. As discussed in more detail below, the rear face of the base part 38 can include an elongated channel 39 within which electrical and electromagnetic components of the hammer bank 36 are disposed.

Figure 3:
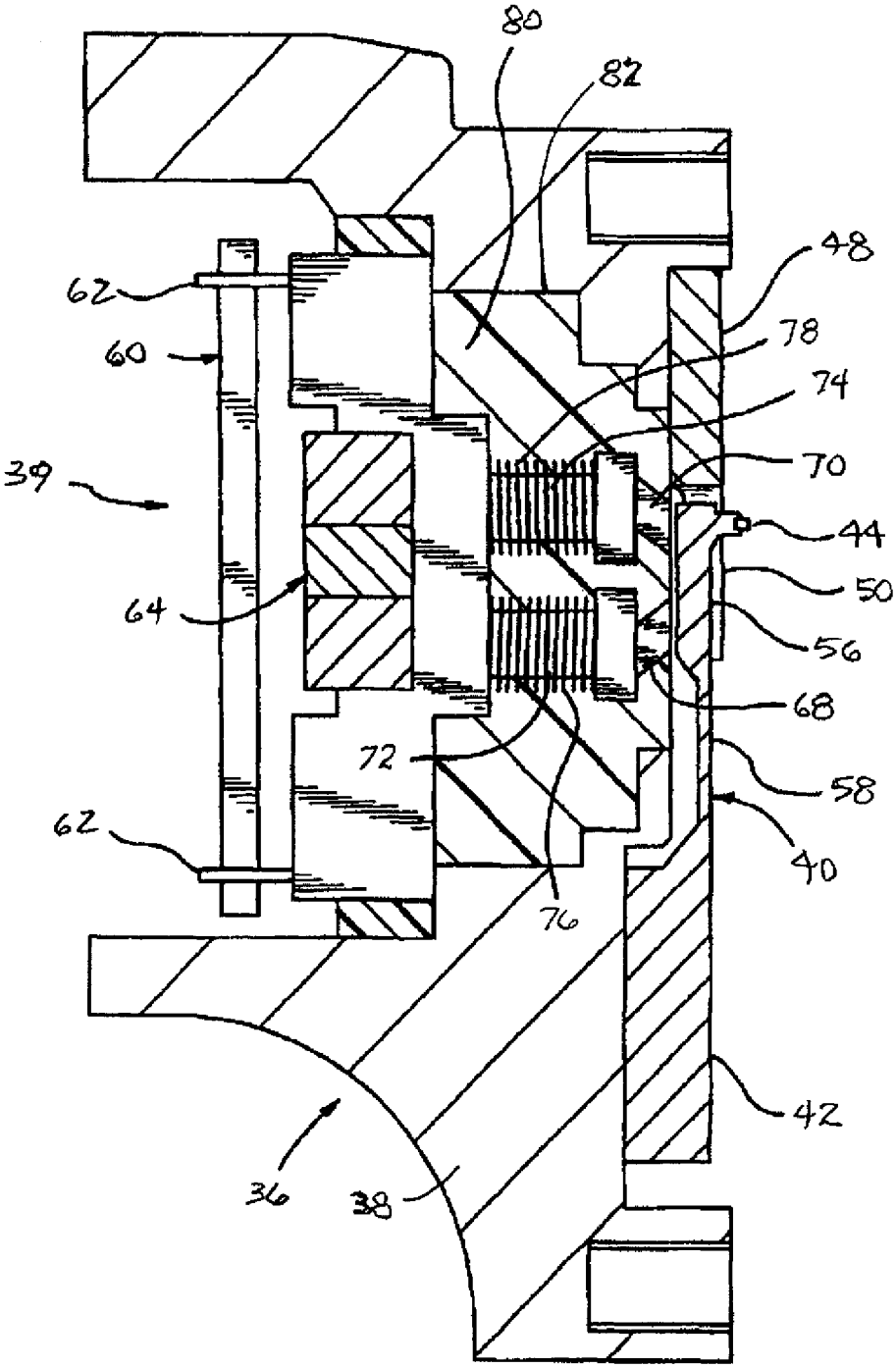
FIG. 3 is a sectional view of a single impact hammer of the prior art hammer bank of FIG. 2, as seen along the lines of the section 3-3 taken therein.

As illustrated in FIG. 3, the hammer bank 36 further includes a second, "shunt fret" 48 having a plurality of downwardly extending, elongated fingers, or magnetic "shunts" 50, that are likewise formed integrally in the shunt fret 48. The shunt fret 48 is formed to include an upper shunt fret plate portion 49 to which the downwardly dependent shunts 50 are connected. Like the hammer fret 42 above, the shunt fret 48 can be secured on the front face of the base part 38 by, e.g., screws 52, with each of the hammers 40 being interdigitated between a pair of adjacent shunts 50.

Both the hammer fret 42 and the shunt fret 48, including the respective integral hammers and shunts 50, are formed of a highly permeable magnetic material, which results in a high degree of magnetic flux conductance through the frets 42 and 48 and their respective hammers 40 and shunts 50.

As shown in FIG. 3, the prior art hammer bank 36 includes a protective cover 52, shown broken away in the figure, that covers the hammer and shunt frets 42 and 48, including the shunts 50, hammers 40 and their respective printing tips 44. The cover 52 includes a plurality of openings 54, each corresponding to and through which a respective one of the printing tips 44 of the hammers 40 can project for impact printing on the print medium 24 (see FIG. 1).

FIG. 3 is a sectional view of the prior art hammer bank 36 of FIG. 2, as seen along the lines of the section 3-3 taken therein, wherein the cover 52 omitted and showing a single hammer 40 and the hammer fret 42 within which it is formed. As illustrated in FIG. 3, the hammer 40 includes an enlarged hammer head 56 on which the elongated printing tips 44 described above are disposed. The hammer head 56 is mounted on the upper end of a relatively narrow, cantilevered spring portion 58 of the hammer 40. As described above, a shunt 50 extends downwardly on either side of the hammer head 56. A printed circuit board 60 is mounted within the channel 39 in the back of the base part 38. The printed circuit board 60 has terminals 62 that enable the circuit hoard 60 to connect to a printer controller (not illustrated).

As further illustrated in FIG. 3, a permanent magnet 64 is also disposed within the channel 39 of the base part 38. The magnetic flux of the permanent magnet 64 serves to retain the hammer 40 in close proximity to or in abutment with a lower pole piece extension 68 and an upper pole piece extension 70. The pole piece extensions 68 and 70 are extensions of lower and upper pole pieces 72 and 74, respectively. The dual pole pieces 72 and 74 have respective electrical coils 76 and 78 wrapped around them. As discussed above, the magnetic force of the permanent magnet 64 pulls the hammer head 56 toward and into juxtaposition with the pole piece extensions 68 and 70 and against a forward bias imposed on the hammer head 56 by the spring portion 58 of the hammer 40. The shunts 50 disposed on either side of the hammer head 56 serve to complete a magnetic flux path from the pole pieces 72 and 74 to the hammer head 56. The hammer head 56 is thus retained until released by a magnetomotive force (MMF) induced in the lower and upper pole pieces 72 and 74 by passing an electrical current through the coils 76 and 78, which "reverse biases" the magnetic flux of the permanent magnet 64, thereby releasing the hammer head 56 to spring forwardly from its magnetic hold.

As illustrated in FIG. 3, the lower and upper pole pieces 72 and 74, together with their corresponding coils 76 and 78 and pole piece extensions 68 and 70, are typically embedded in a bed 80 of epoxy formed in a front cavity 82 of the base part 38 to form a relatively monolithic structure.

While conventional hammer banks, such as that illustrated and described above, can provide satisfactory print quality and speeds, they are not without certain drawbacks. For example, as can be seen in, e.g., FIGS. 2 and 3, the prior art hammer bank 36 includes a machined or die cast base part 38 that is integrated into and forms part of the shuttle mechanism 34 of the line printer 10. This makes both the hammer bank 36 and the shuttle mechanism 34 more difficult and expensive to manufacture, and makes the hammer bank 36 relatively difficult to remove as a separate component for servicing or replacement, especially in the field. Additionally, as can be seen in, e.g. FIG. 3, prior art hammer banks 36 typically incorporate relatively complex, "dual pole piece" magnetic actuators for the control of each hammer 40, which adds to their complexity and cost of manufacture.

Figure 4:
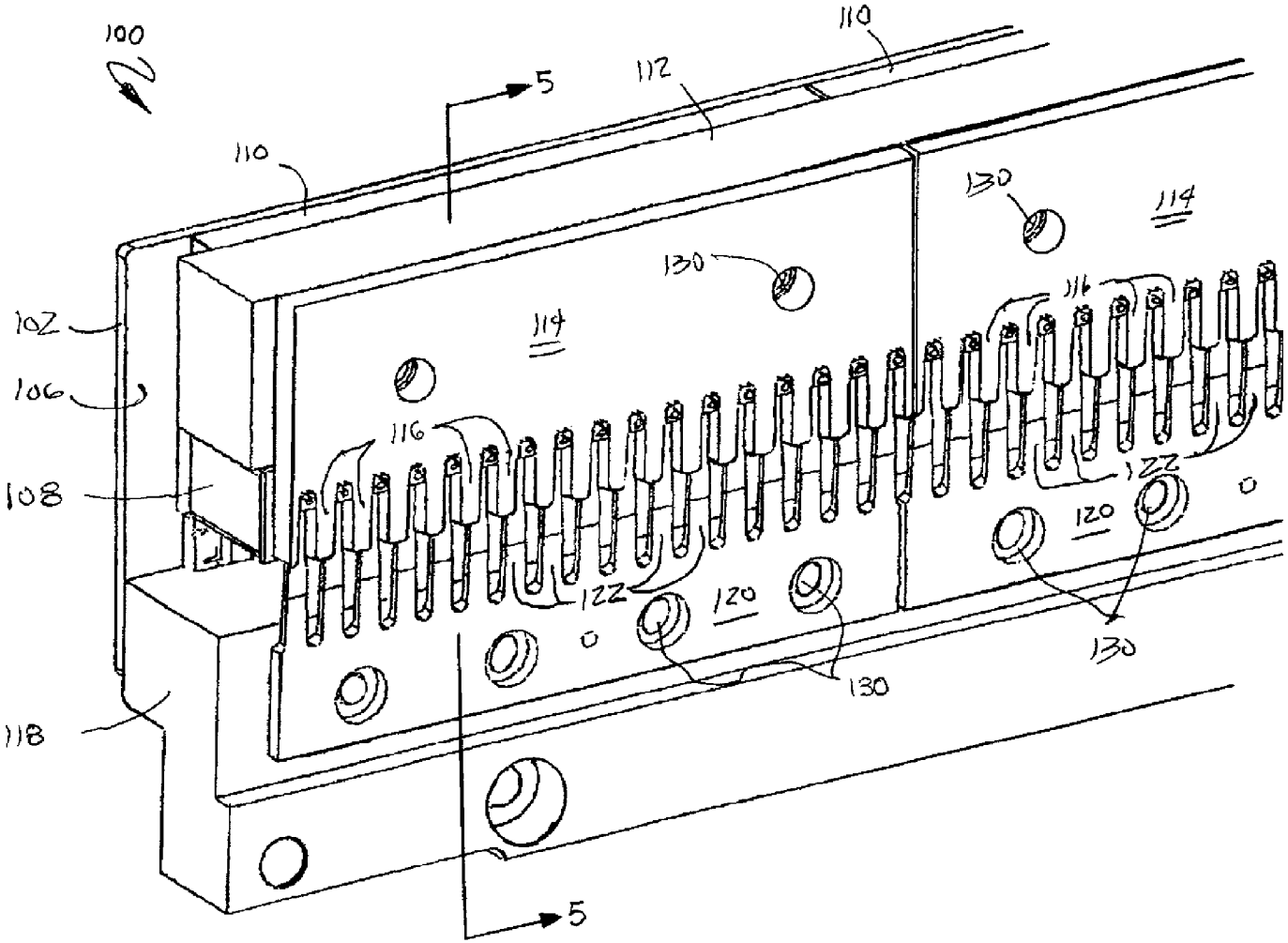
FIG. 4 is a partial, upper, front and left-side perspective view of a front face of an example embodiment of a hammer bank in accordance with the present invention.
Figure 5:
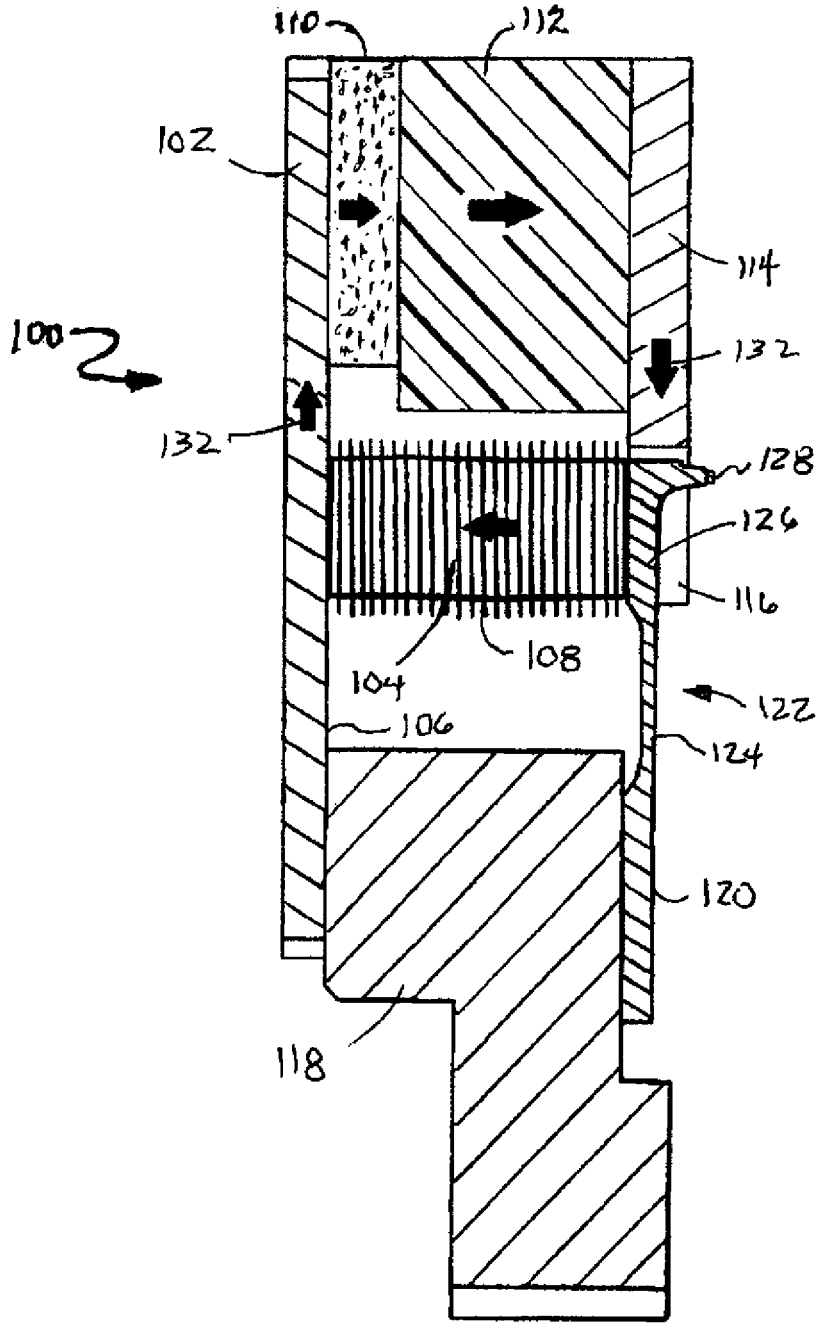
FIG. 5 is a sectional view of the example hammer bank of FIG. 4, as seen along the lines of the section 5-5 taken therein, showing a single impact hammer thereof.

FIG. 4 is a partial, upper, front and left-side perspective view of a front face of an example embodiment of a hammer bank 100 in accordance with the present invention, which overcomes many of the above and other drawbacks of prior art hammer banks. FIG. 5 is a sectional view of the example hammer bank of FIG. 4, as seen along the lines of the section 5-5 taken therein, showing the details of a single impact hammer and associated control magnetics thereof.

As illustrated in FIGS. 4 and 5, which respectively correspond to FIGS. 2 and 3 of the prior art hammer bank 36 described above, the example hammer bank 100 includes a back plate 102 and a plurality of elongated pole pieces 104 extending forwardly from a front surface 106 thereof. Each pole piece 104 has an electrical coil 108 disposed about a circumfery thereof. The construction of the back plate 102 and pole pieces 104 is described in more detail below in conjunction with FIG. 7.

In the particular example embodiment illustrated in FIGS. 4 and 5, and referring to the upper portion thereof, a permanent magnet 110 has a back surface that is magnetically coupled to the front surface 106 of the back plate 102, and a flux bar 112 has a back surface that is magnetically coupled to a font surface of the permanent magnet 110. A shunt fret 114 that defines a plurality of elongated, downwardly extending shunts 116 has a back surface that is magnetically coupled to a font surface of the permanent magnet 110.

Referring to the lower portions of FIGS. 4 and 5, a hammer fret mounting bar 118 has a back surface that is coupled to the front surface 106 of the back plate 102, and a hammer fret 120 has a back surface that is coupled to a front surface of the hammer fret mounting bar 118. The hammer fret 120 defines a plurality of elongated, upwardly extending hammers 122. Each of the hammers 122 is interdigitated between a pair of adjacent shunts 116 and includes an elongated spring portion 124 that has a hammer head 126 disposed at an upper end thereof. Each hammer head 126 has a printing tip 128 projecting forwardly therefrom.

As illustrated in FIGS. 4 and 5, the back plate 102, permanent magnet 110, flux bar 112, shunt fret 114, hammer fret mounting bar 118 and hammer fret 120 can be sandwiched with each other and held together in a rigid assembly by, for example, a plurality of fasteners 130, such as bolts or screws, that can extend partially or completely through the assembly. Additionally, as can be seen in FIG. 4, in some embodiments, the permanent magnet 110, the shunt fret 114 and the hammer fret 120 can be split into bilaterally symmetrical halves for ease of manufacture and assembly without adversely affecting the function of the hammer bank 100.

As those of skill in the art will understand, it is desirable that at least the back plate 102, the pole pieces 104, the flux bar 112, the shunt fret 114 and the hammer fret 124 be constructed of a magnetically permeable material. As illustrated in FIG. 5, by so doing, a magnetic flux path, as indicated by the arrows 132, is established in the hammer bank 100 by the permanent magnet 110. The flux path 132 extends from the permanent magnet 110, through the flux bar 112, the shunt fret 114, the hammers 122, the pole piece 104, the back plate 102, and thence, back to the permanent magnet 110.

As in the prior art hammer bank 36 described above, the magnetic flux acts to pull the head 126 of the hammer 122 back toward and into juxtaposition with the front end of the pole piece 102 and against a forward bias exerted on the hammer head 126 by the spring portion 124 of the hammer 122. As discussed below in connection with FIG. 6, the shunts 116 disposed on either side of the hammer head 126 serve to complete the flux path 132 from the pole piece 102 to the hammer head 126 while enabling the hammer head 126 to move freely when released. The hammer head 126 is thus retained in juxtaposition with the single pole piece 102 until it is released to spring forwardly in response to the forward bias of the spring portion 124 of the hammer 122. As above, this is effected by passing an electrical current through the coil 108 so as to induce a magnetomotive force (MMF) in the pole piece 104 that interrupts the magnetic flux path 32, thereby releasing the hammer head 126, and hence, the associated printing pin 128, to spring forwardly so as to impact an ink ribbon and print a dot on a print medium.

Figure 6:
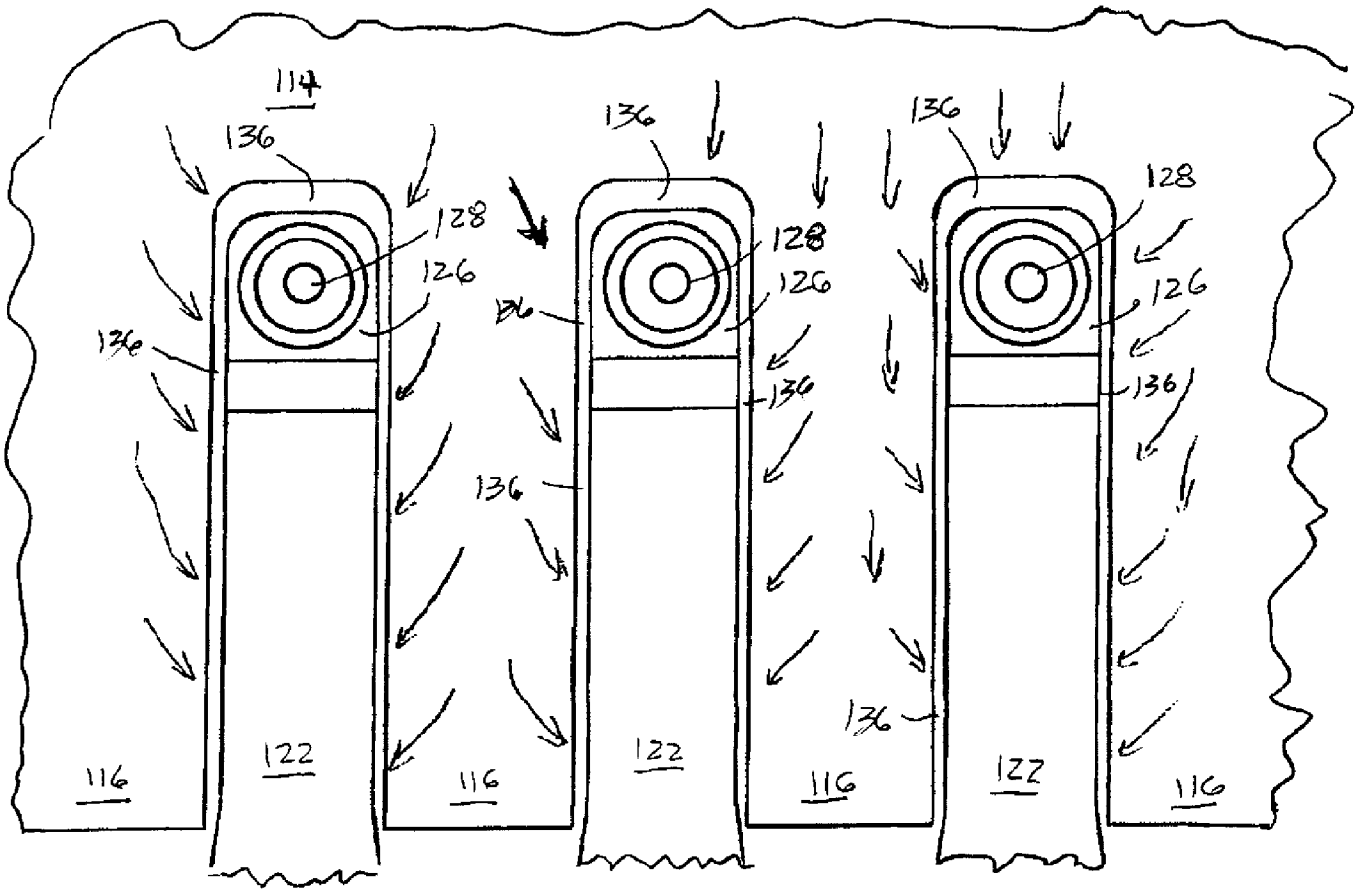
FIG. 6 is a partial front elevation view of three impact hammers and associated flux shuts of the example hammer banks of FIGS. 4 and 5, showing the flow of magnetic flux in the shunts.

FIG. 6 is a partial front elevation view of three impact hammers 122 and associated flux shuts 116 of the example hammer bank of FIGS. 4 and 5, showing the direction, as indicated by the arrows 134, taken by the magnetic flux in flowing from the shunts 116 to the hammers 122, and thence, to the front ends of their associated pole pieces 104 respectively located behind the hammers 122 (see FIG. 5). As may be seen in FIG. 6, the magnetic shunts 116 are separated from the hammers 122 by relatively narrow air gaps 136. Because the magnetic flux is able to bridge the air gaps 136 relatively easily, this arrangement enables the hammers 122 to move back and forth freely, while maintaining the continuity of the magnetic flux paths 132 respectively controlling the movement of the hammers 122.

Figure 7:
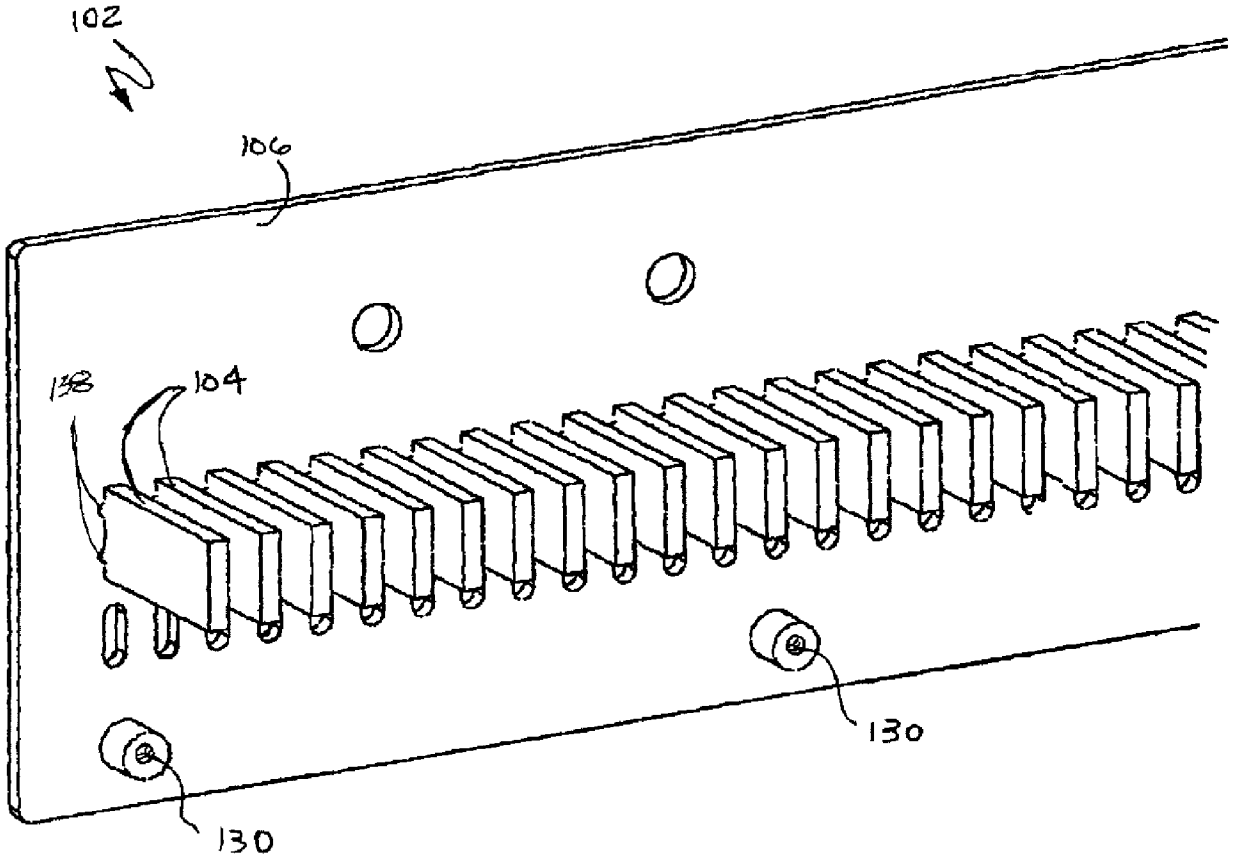
FIG. 7 is a partial upper, front and left-side perspective view of an example embodiment of a back plate of the example hammer bank of FIG. 4.

FIG. 7 is a partial upper, front and left-side perspective view of the back plate 102 of the example hammer bank 100 of FIGS. 4 and 5, showing the pole pieces 104 protruding forwardly from the front face 106 thereof. As discussed above, the corresponding structure, i.e., the base part 38 of the prior art hammer bank 36 of FIGS. 2 and 3, is typically a machined or die cast part, and a comparison of the two structures reveals that the base plate 102 is considerably simpler in its implementation, and indeed, comprises a generally flat plate that can be, for example, die-stamped from a sheet of an appropriate material.

Additionally, as shown in FIG. 7, in which the respective electrical coils 108 of the pole pieces 104 have been omitted for clarity, the pole pieces 104 themselves can also comprise generally flat, rectangular bars, as opposed to the cylindrical pole pieces 72, 74 of the prior art. Thus, the pole pieces 104 can, like the back plate 102, be produced efficiently by stamping them from bar stock of an appropriate material, making them considerably simpler and less expensive to manufacture. Further, as may be seen in FIGS. 5 and 7, the pole pieces 104 can be directly coupled to the front face 106 of the base plate 102, rather than indirectly through, e.g., "lossy" intervening components, such as pole piece extensions, thereby further simplifying construction and reducing fabrication costs. The back end of each of the pole pieces can be attached to the front surface 106 of the back plate 102 with any magnetically permeable attachment process, such as, for example, stakes 138, as illustrated in the example of FIG. 7, as well as other attachment mechanisms, including press fitting, riveting; brazing, welding or adhesive bonding.

The straightforward design of the stamped base plate 102 and pole pieces 104 provides a robust supporting structure for the hammer bank 100 and, when coupled with the enhancement of the magnetic pull-down force for the print hammers 122 provided by the use of the flux shunts 116, enables the use of a single impact pole piece 104 for retracting a print hammer 122, rather than the more complex and expensive dual pole piece design of the prior art (see, e.g., FIG. 3). This, in turn, enables the single-pole-piece hammer bank 100 to exhibit a print energy equal to that of the more complex and costly prior art dual pole piece hammer banks.

Figure 8:
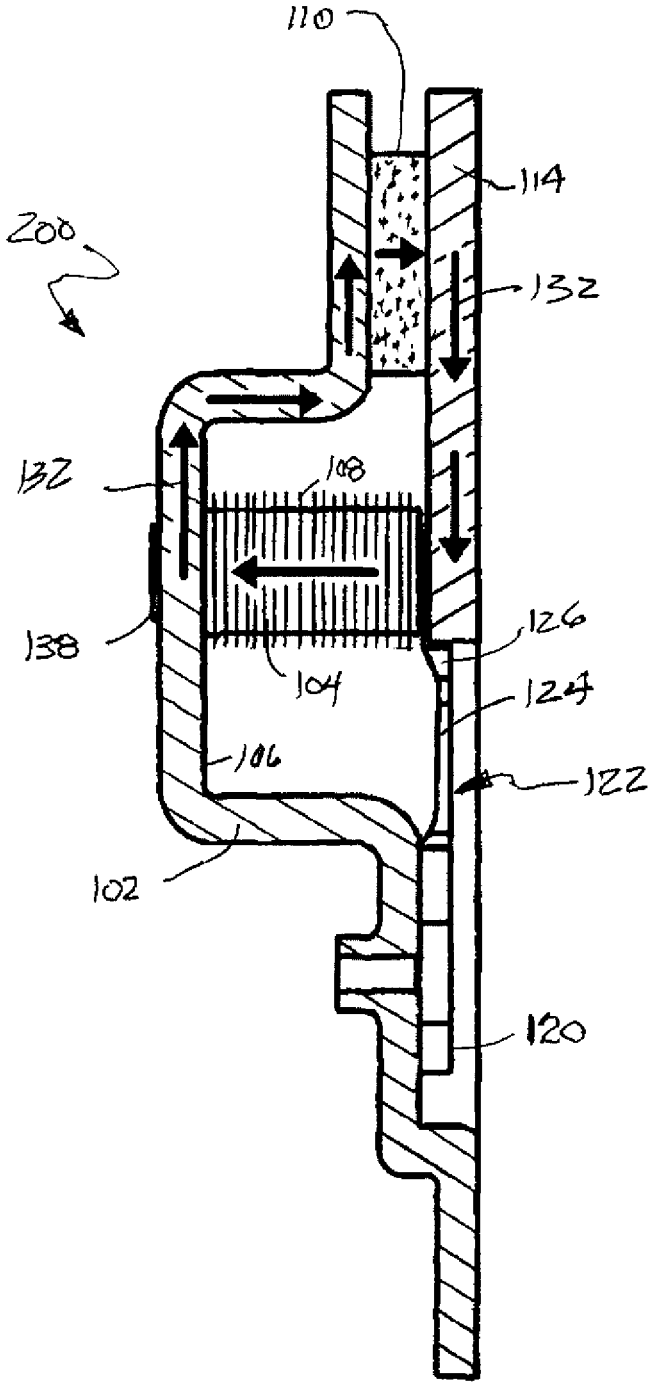
FIG. 8 is a cross-sectional view of an alternative embodiment of a hammer bank and associated control magnetics in accordance with the present invention.

FIG. 8 is a cross-sectional view, similar to that presented in FIG. 5, of an alternative embodiment of a hammer bank 200 in accordance with the present invention. As can be seen from a comparison of FIGS. 5 and 8, the hammer bank 200 is similar to the first example hammer bank 100 described above, except that additional efficiencies in the design have been achieved by forming the back plate 102 to incorporate lateral bends that define portions which are offset from and parallel to the front surface 106 of the back plate 102, as well as portions that are substantially perpendicular to the front surface 106 thereof.

The bends and the offset and perpendicular portions can be formed in the originally flat base plate 102 design of the first embodiment 100 above by, for example, well-known stamping, pressing or forging operations. As those of some skill will appreciate, the bends and offsets in the base plate 102 serve not only to enhance the stiffness of the base plate 102, and hence, the hammer bank 200, in the lateral direction, but also to enable the flux bar 112 and hammer fret mounting bar 118 of the first embodiment 100 above to be eliminated, thereby achieving an economy in manufacturing. As in the first hammer bank 100 described above, the components of the hammer bank 200 can be sandwiched together in close magnetic coupling with each other and held together with inexpensive fasteners, such as rivets or bolts.

As those of skill in the art will appreciate, the respective structures of the example hammer banks 100 and 200 illustrated and described above are such as to impart substantial vertical and lateral rigidity to the respective hammer bank assemblies, without the need for a more robust base part, which is typically substantially integrated with the shuttle mechanism in hammer banks of the prior art. Accordingly, using hammer bank designs of the type disclosed herein enable such prior art base parts to be replaced with a simple hammer bank "carrier frame" that is integral to the shuttle mechanism and to which the new hammer bank designs 100 and 200 are removably attached, e.g., by one or more fasteners, such as screws or bolts. This, in turn, enables the hammer banks to be easily removed from the shuttle mechanism, e.g., in the field, for repair or replacement, and additionally, enables the hammer banks to be fabricated and assembled separately from the shuttle mechanisms, e.g., at different manufacturing facilities.

Indeed, in light of the foregoing description, it should now be clear that many modifications, substitutions and variations can be made in and to the materials, apparatus, configurations and methods of use of the novel line printer hammer banks of the present disclosure, and in light thereof, that the scope of the present disclosure should not be limited to that of the particular embodiments illustrated and described herein, which are merely by way of some examples thereof, but rather, should be fully commensurate with that of the claims appended hereafter and their functional equivalents.

What is claimed is:

1. A hammer bank, comprising:

a back plate;

a plurality of elongated pole pieces coupled to the back plate and extending forwardly from a front surface thereof, each pole piece having an electrical coil disposed about a circumfery thereof;

a permanent magnet having a back surface coupled to the front surface of the back plate;

a shunt fret defining a plurality of elongated, downwardly extending shunts and having a back surface coupled to a front surface of the permanent magnet; and a hammer fret having a back surface coupled to the front surface of the back plate and defining a plurality of elongated, upwardly extending hammers, each hammer being interdigitated between a pair of adjacent shunts and including an elongated spring portion having a hammer head disposed at an upper end thereof, each hammer head having a printing tip projecting forwardly therefrom.

2. The hammer bank of claim 1, further comprising:

a flux bar interposed between the front surface of the permanent magnet and the back surface of the shunt fret; and a hammer fret mounting bar interposed between the front surface of the back plate and the back surface of the hammer fret.

3. The hammer bank of claim 2, wherein at least one of the back plate, the flux bar, the shunt fret and/or the hammer fret is made of a magnetically permeable material.

4. The hammer bank of claim 2, wherein the back plate comprises a generally flat plate.

5. The hammer bank of claim 4, wherein the back plate comprises a stamping.

6. A line printer incorporating the hammer bank of claim 2.

7. The hammer bank of claim 1, wherein the back plate comprises a stamping.

8. The hammer bank of claim 1, wherein at least one of the pole pieces comprises a generally flat, rectangular bar.

9. The hammer bank of claim 8, wherein the at least one pole piece comprises a stamping.

10. The hammer bank of claim 1, wherein a back end of each of the pole pieces is coupled to the front surface of the back plate with a magnetically permeable coupling.

11. The hammer bank of claim 10, wherein the coupling comprises a press fitting, a stake, a rivet, a brazed joint, a welded joint or an adhesive joint.

12. The hammer bank of claim 1, further comprising a cover disposed over a front face of the hammer bank, the cover including a plurality of openings, each corresponding to and through which a respective one of the printing tips of the hammers can project.

13. A line printer incorporating the hammer bank of claim 1.

14. A line printer, comprising:

a shuttle mechanism; and a hammer bank coupled to the shuttle mechanism for horizontal reciprocating movement by the shuttle relative to a vertically moveable print medium, wherein the hammer bank comprises:

a back plate;

a plurality of elongated pole pieces extending forwardly from a front surface of the back plate, each pole piece having an electrical coil disposed about a circumfery thereof;

a permanent magnet having a back surface coupled to the front surface of the back plate;

a shunt fret having a back surface coupled to a font surface of the permanent magnet and defining a plurality of elongated, downwardly extending shunts; and a hammer fret having a back surface coupled to the front surface of the back plate and defining a plurality of elongated, upwardly extending hammers, each hammer being interdigitated between a pair of adjacent struts and including an elongated spring portion having a hammer head disposed at an upper end thereof, each hammer head having a printing tip projecting forwardly therefrom.

15. The line printer of claim 14, wherein the hammer bank further comprises:

a flux bar interposed between the front surface of the back plate and the back surface of the shunt fret; and a hammer shunt mounting bar interposed between the front surface of the back plate and the back surface of the hammer fret.

16. The line printer of claim 14, wherein:

the shuttle mechanism comprises a moveable hammer bank carrier frame; and the hammer bank is removably coupled to the carrier frame by one or more fasteners.

17. A method for making a hammer bank for a line printer, the method comprising:

attaching a back end of each of a plurality of elongated pole pieces to a front surface of a back plate such that the pole pieces extend forwardly therefrom and are arranged in a line and disposed generally parallel to one another, disposing an electrical coil about a circumfery of each of the pole pieces;

coupling a back surface of a permanent magnet to the front surface of the back plate;

coupling a back surface of a shunt fret to a font surface of the permanent magnet, the shunt fret defining a plurality of elongated, downwardly extending shunts; and coupling a back surface of a hammer fret to the front surface of the back plate, the hammer fret defining a plurality of elongated, upwardly extending hammers, each hammer being interdigitated between a pair of adjacent shunts and including an elongated spring portion having a hammer head disposed at an upper end thereof, each hammer head having a printing tip projecting forwardly therefrom.

18. The method of claim 17, further comprising:

interposing a flux bar between the front surface of the back plate and the back surface of the shunt fret; and interposing a hammer fret mounting bar between the front surface of the back plate and the back surface of the hammer fret.

19. The method of claim 17, wherein the providing comprises stamping the back plate from a generally flat sheet of material.

20. The method of claim 17, wherein the attaching comprises a staking, riveting, press fitting, brazing, welding or adhesive bonding process.

* * * * *